US005799842A

United States Patent [19]

Rumsey

[11] Patent Number: 5,799,842

[45] Date of Patent: Sep. 1, 1998

[54] METHOD AND APPARATUS FOR FOSTERING A DESIRED APPEARANCE IN CERTAIN WOMEN'S GARMENTS

[76] Inventor: Shirley J. Rumsey, 1021 Shenandoah Dr., Arlington, Tex. 76014

[21] Appl. No.: 755,605

[22] Filed: Nov. 25, 1996

[51] Int. Cl.[6] ..... A41H 43/00

[52] U.S. Cl. ..... 223/1; 223/28; 223/DIG. 2

[58] Field of Search ..... 223/1, 69, 71, 223/61, 28, 97, DIG. 2, 85

[56] References Cited

U.S. PATENT DOCUMENTS

| | | | |
|---|---|---|---|
| D. 190,608 | 6/1961 | Forrester | 80/8 |
| D. 211,795 | 7/1968 | Wooten | 33/8 |
| 271,640 | 2/1883 | Kelly | 223/88 |
| 1,691,123 | 11/1928 | Pajeau | 223/DIG. 1 |
| 2,119,604 | 6/1938 | Shepard | 223/69 |
| 2,168,710 | 8/1939 | Johnson | 223/88 |
| 2,594,228 | 4/1952 | Smith | 223/88 |
| 4,709,838 | 12/1987 | Campbell | 223/DIG. 4 |
| 4,778,088 | 10/1988 | Miller | 223/91 |
| 5,065,915 | 11/1991 | Rösch | 223/85 |

FOREIGN PATENT DOCUMENTS

| | | | |
|---|---|---|---|
| 464784 | 7/1926 | Germany | 223/28 |
| 2265824 | 10/1993 | United Kingdom | 223/85 |

OTHER PUBLICATIONS

Fairchild's Dictionary of Fashion.
Claire Shaeffer's Fabric Sewing Guide.
Reader's Digest Complete Guide to Sewing.
The Art of Sewing/The Classic Techniques.

*Primary Examiner*—Bibhu Mohanty
*Attorney, Agent, or Firm*—George R. Schultz; Strasburger & Price

[57] ABSTRACT

An apparatus for storing a certain garments in a twisted manner when drying or not being worn to produce a desired appearance when worn. The apparatus consists of a helical structural frame having a top and bottom and a longitudinal axis therebetween with a pitch large enough to permit portions of a garment to be manually forced and twisted between aligned and spaced-apart segments of the frame.

16 Claims, 5 Drawing Sheets

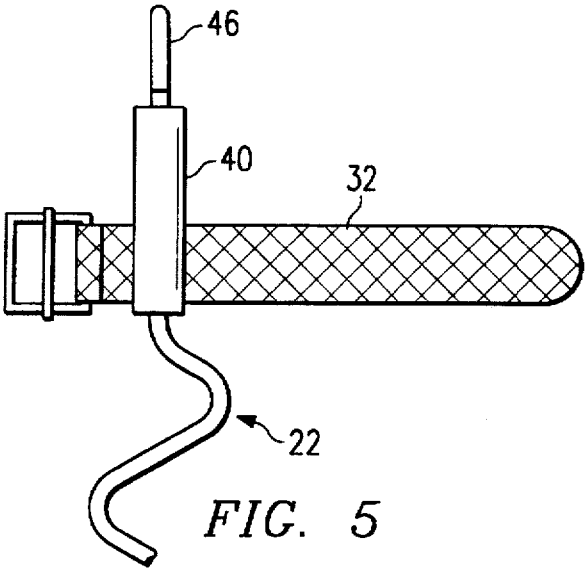
FIG. 5
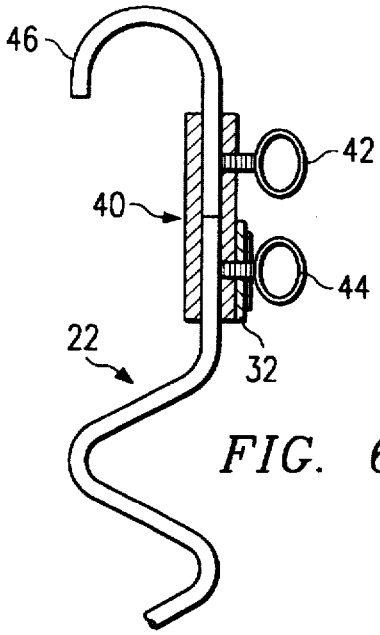
FIG. 6
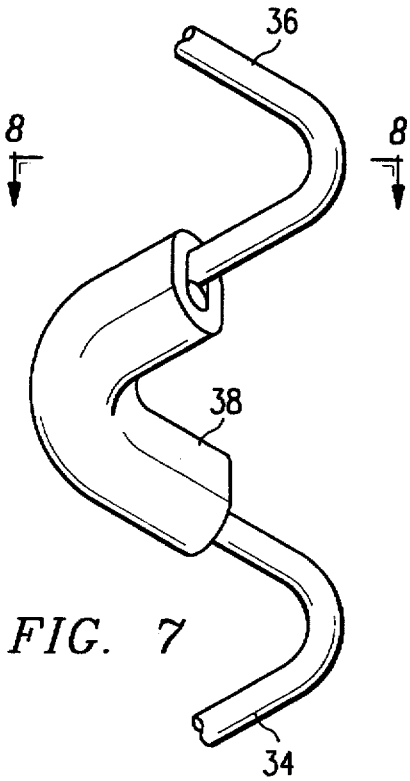
FIG. 7
FIG. 8
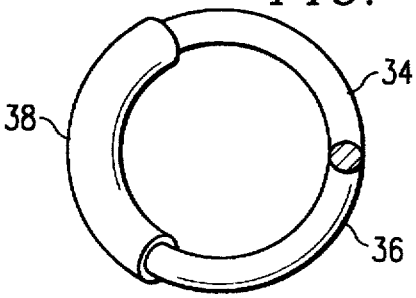
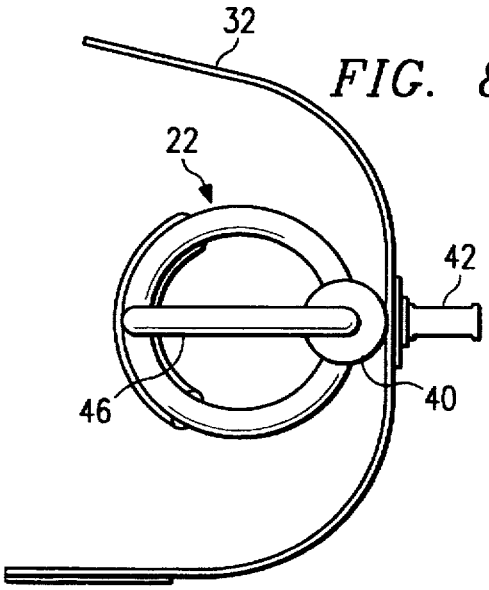
FIG. 8A FIG. 11
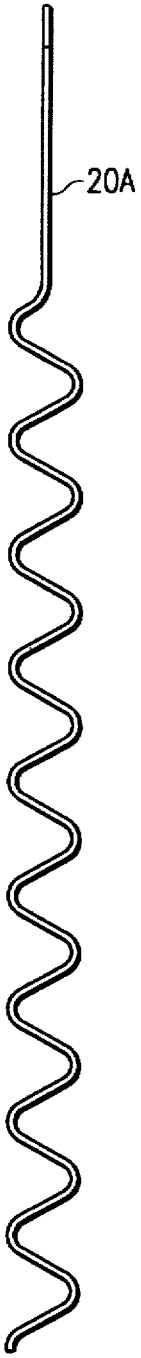
FIG. 11A
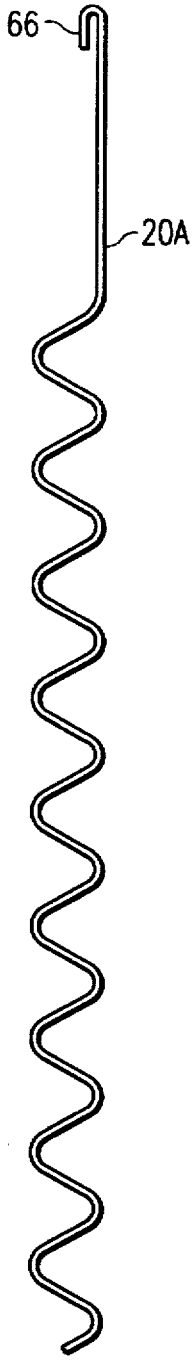
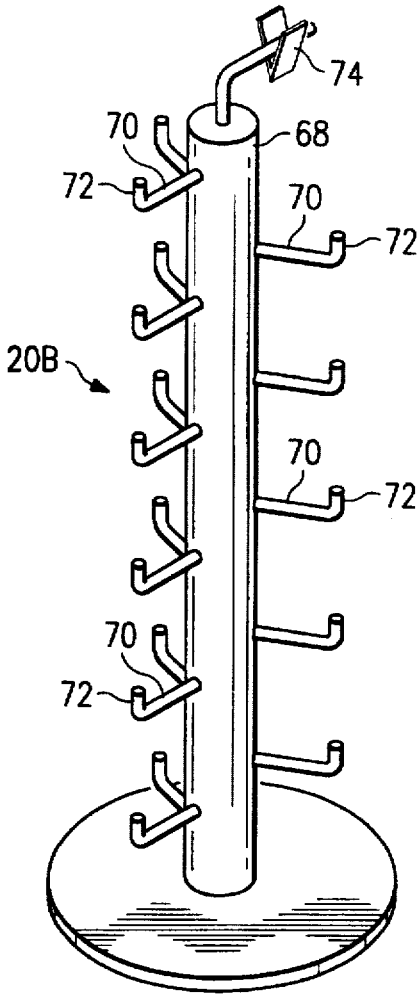
FIG. 13
FIG. 12
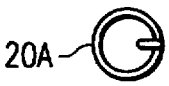
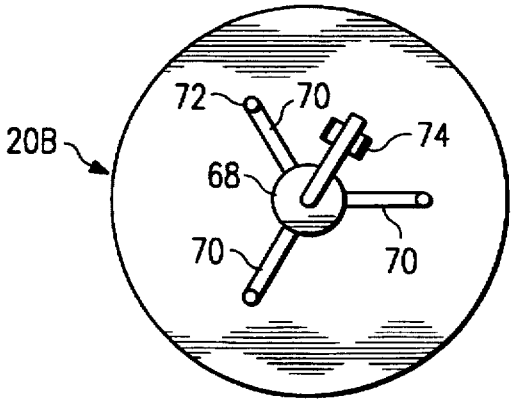
FIG. 14

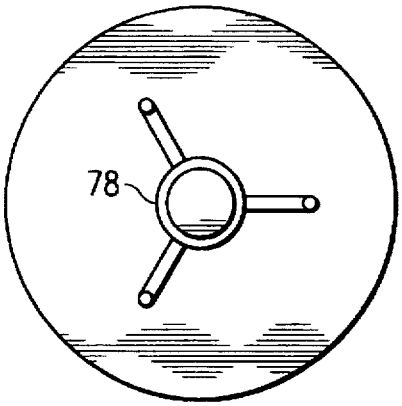
FIG. 15
FIG. 16
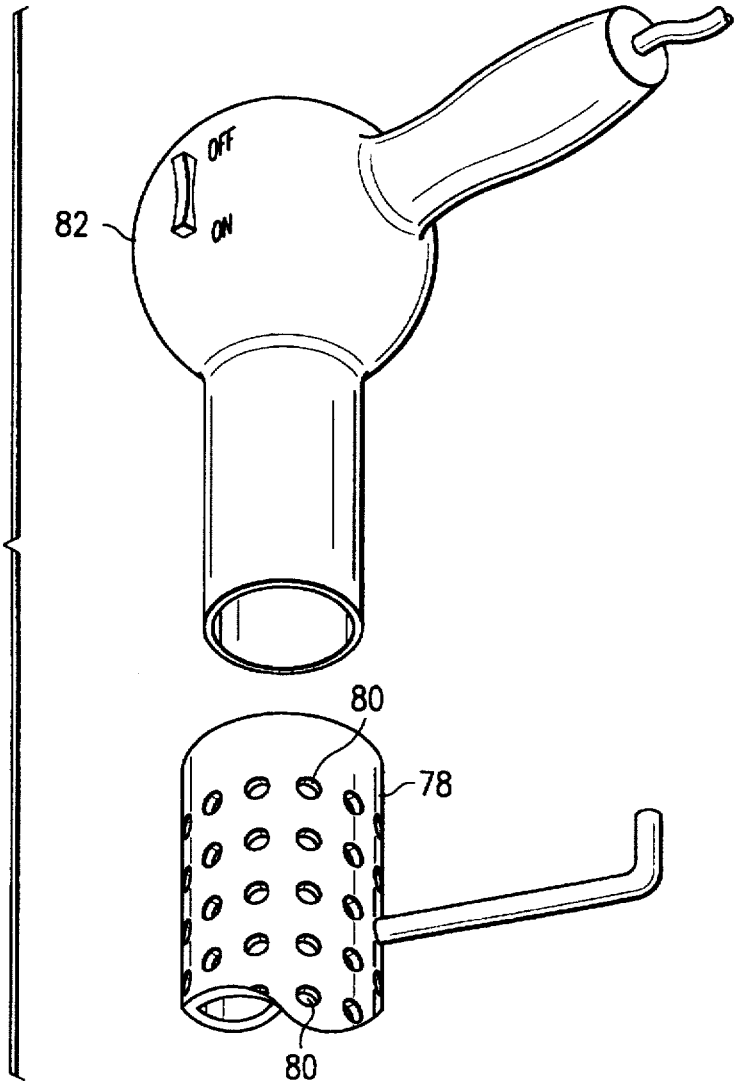

METHOD AND APPARATUS FOR FOSTERING A DESIRED APPEARANCE IN CERTAIN WOMEN'S GARMENTS

FIELD OF THE INVENTION

This invention relates generally to an apparatus for use in supporting certain women's garments (e.g., skirts, dresses, culottes and shorts, etc.) made of a variety of materials, said garments being distinctive in having a large quantity of relatively narrow pleats that may be characterized as being "casual" or slightly wrinkled; more specifically, the invention relates to a structural frame around which a garment can be wrapped (and held until it is dry) and/or stored in such a way that the many narrow pleats will have an appealing look when the garment is to be worn.

BACKGROUND OF THE INVENTION

In recent years certain garments have become popular in the United States among a major segment of "main stream" clothes buyers. The garments include skirts, dresses, shorts, culottes and the like, and the materials from which the garments are made include both natural fibers (e.g., cotton) and made-made fibers (e.g., nylon). The thing that distinguishes all of the garments being considered is the presence of a great number of relatively narrow and "soft" pleats, said pleats generally starting near the waist and extending downwardly to the garment's hem. The pleats give the garments a shaped but relaxed and almost casual appearance, and the garments are referred to by a variety of names—the most common of which seems to be "broomstick." Some persons say that that the nickname "broomstick" for such a garment was derived from a popular way of handling the garment after it has been laundered. It is said that after a garment (e.g., a skirt) has be en washed and the bulk of the water has been removed from it, it is suspended over the handle part (i.e., the stick) of a broom, and the skirt's waist is secured to the top of the handle with a string or rubber band. Beginning a few inches below the top of the handle, and repeating the action every few inches downward along the handle, short pieces of string are used to tie the skirt tightly around the handle. Hours—or days—later, after the skirt has air-dried, the strings are untied and the skirt is gently shaken; because of the tightness with which the strings have been tied, the "tied" regions still appear to be somewhat gathered or compressed. The regions of the skirt intermediate the "tied" regions appear to be fluffy or bulbous, giving the skirt an over-all appearance of having been given a lot of attention and/or special treatment, when really it i s simply the inherent character of the material, plus several judiciously placed ties—and an appropriate amount of elapsed time.

Another reason for the popularity of such garments may be that they seem to be handy for women who are regular travelers. The garments can often be squeezed into a tightly packed suitcase, and then hung in a closet for a few hours without showing as much travel deterioration as do other, more formal garments that are regularly pressed or dry cleaned. As for daily wear, the general "texture" of a multi-pleated garment does not show soil as readily as smooth, flat material; hence, it can often be worn for several hours without looking like it has been worn for several hours.

According to *Fairchild's Dictionary of Fashion*, 1988, a "broomstick" skirt is a "full skirt which, after washing, is tied tightly with a string around a broomstick. When dry, it contains vertical ridges or wrinkles. Popular in the 1940s and somewhat revived in the late 1960s." Other instructions by some manufacturers include twisting a skirt about a generally longitudinal axis—to form a rope-like shape, and then tying the "rope" into a knot. Another manner of dealing with a wet skirt is to twist it into a rope-like configuration and then hold it securely in place by pulling one leg of an old pair of panty hose downward around the skirt—to prevent it from "unraveling" until it has become dry and is ready to be "unleashed." (perhaps it should also be noted that this task is more easily accomplished if two people are working on it—rather than just one. Hence, willing husbands or others are often implored to participate in the mounting of a wet skirt on a broom handle.)

Garments in the form of dresses differ from the skirt versions only in having a upper portion that covers the upper part of the torso; the lower portions of the two garments, i.e., the portions below the waist (with the pleats), are essentially the same. In view of the fact that this invention is concerned with correctly shaping that part of a garment that has pleats and hangs below the waist, the term "skirt" will hereinafter be used herein as a convenient way of referring to all such garments. And without intending to limit the scope of the invention, the term "broomstick" will be used as a general way of referring to the garments—which may be characterized as being relatively full and having numerous narrow pleats (on the order of ½ to ¾ inch wide) that have a somewhat casual appearance. That is, unlike the meticulously tailored and "sharp" pleats of the prior art (in materials such as, for example, Gabardine), the pleats of broomstick garments universally have a more relaxed and informal appearance.

The drying procedures of the prior art (described above) have at least two significant drawbacks. First, a wet skirt secured to a broom handle and covered with a panty hose "shroud" is not likely to dry very rapidly; in fact, it sometimes takes two or more days for a skirt to dry in any but the most arid climates with very low humidities. And a knotted skirt usually doesn't dry as fast as one wrapped around a broom handle. So in a humid environment, a skirt could just as likely be afflicted with mildew before it becomes completely dry. Second, a knotted skirt can produce a bottom or hem on a dry skirt that is uneven, because there is very little (if any) control over how adjacent portions of a knotted skirt are positioned before they are set aside for drying. For those persons who are just a little bit particular about their appearance, the hem of a skirt that has an unintended wavy or scalloped (i.e., up and down) shape is less than desirable. Therefore, it is an object of this invention to satisfy the need for an improved way of taking care of broomstick garments, and especially fostering a quicker and more controlled manner of drying them after they have been laundered.

Another object is to provide a long-term manner of storing broomstick garments so that they tend to maintain their shape for extended periods of time.

A further object is is to provide an apparatus that fosters the ability of taking care of a broomstick garment by a single person—without requiring the assistance of a second person.

These and other objects will be apparent from a careful reading of the specification and claims that follows, together with an inspection of the several figures of the drawing that accompany this text.

DESCRIPTION OF THE SEVERAL FIGURES OF THE DRAWING

FIG. 5 is an enlarged view of the top of the apparatus shown in FIG. 2, said view being enlarged in order to better reveal the details of said top;

FIG. 6 is an enlarged view of the top of the apparatus as shown in FIG. 3, and showing one manner in which connections may be mechanically made between two parts of one embodiment;

FIG. 7 is a perspective view of one manner of mechanically joining two spiral-shaped rod-like elements in a first embodiment;

FIG. 8 is a transverse cross-sectional view of the embodiment shown in FIG. 7, said view looking downwardly along the longitudinal axis of the apparatus, and the transverse cutting plane being represented by the line VIII—VIII in FIG. 7;

FIG. 8A is a top view of the apparatus shown in FIG. 2, looking downwardly along the longitudinal axis of the apparatus shown in FIG. 2;

FIG. 11 is a front elevational view of another embodiment of the invention that is characterized by simplicity as far as its manufacturing is concerned, and primarily constituting a one-piece helically coiled wire;

FIG. 11A is an elevational view perpendicular to that of FIG. 11;

FIG. 12 is a top view of the embodiment shown in FIG. 11, looking along the longitudinal axis of the coiled wire;

FIG. 13 is a perspective view of another embodiment of the invention that has a structural frame in the form of a central, solid core;

FIG. 14 is a top plan view of the embodiment shown in FIG. 13;

FIG. 15 is a top plan view of an embodiment that has a structural frame in the form of a hollow tube—through which drying air may be blown to foster drying of a wet garment that has been wrapped around the hollow tube; and FIG. 16 is a fragmentary perspective view of the embodiment shown in FIG. 15, and showing an exemplary hair dryer positioned at the top of the hollow tube.

BRIEF DESCRIPTION OF THE INVENTION

Figure 1:
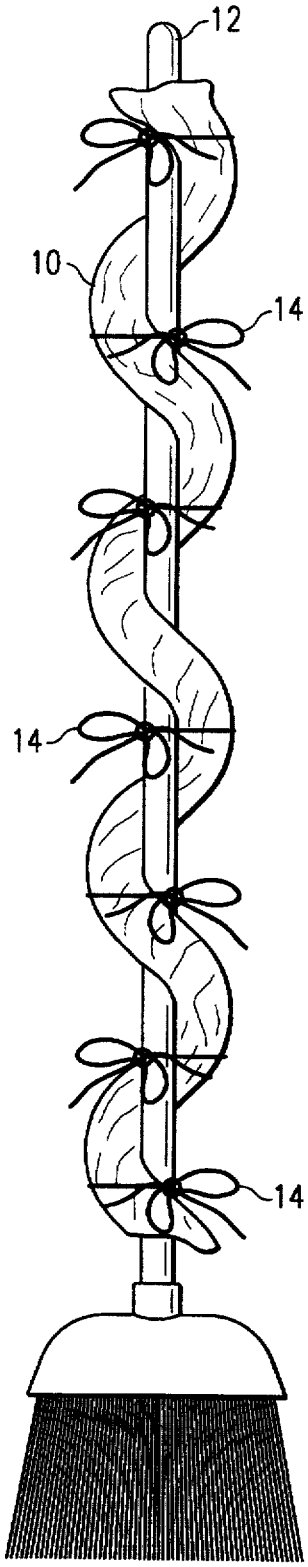
FIG. 1 (PRIOR ART)
FIG. 1 is a perspective view of a manner of drying a broomstick skirt in accordance with the prior art.

In brief, the inventive concept involves an apparatus that includes parts that serve at least two distinct functions; optional parts may also be provided. First, there is a mandatory structural frame that is expected to be normally suspended in a generally vertical manner, such that it may be aptly described as having a top and a bottom. At the top of the structural frame is some kind of a mechanical means for holding a garment (e.g., a woman's skirt) so that the top of the garment will be held stationary with respect to the structural frame. An exemplary mechanical means is a flexible strap of nylon or the like, together with a non-rusting buckle that can secure the flexible strap around the top of the garment. A strap including a lengthy section of a hook-and-loop fastener may alternatively be used to wrap around and securely grip the top of the garment. Another alternative for holding a garment is a sturdy spring-biased clamp that may be rigidly attached to the top of the structural frame, where the clamp may be used to grip the top of the garment and hold it against movement. The mechanical means for holding the top of a garment to the top of the structural frame may be permanently affixed to the structural frame, or it may be selectively removable from the frame.

An optional part for the total apparatus is a mechanical means provided near the bottom of the structural frame—for securely holding the bottom of the garment with respect to the structural frame. One form of such a mechanical means is a strap and buckle, much like a strap that is used at the top of the structural frame. An alternate means is a hook-like device that is permanently fixed to the structural frame in such a way that the bottom of the garment can be wedged into a space immediately adjacent the structural frame. Still another mechanical means can be a strong rubber band.

In one embodiment the structural frame is a long metal rod that is bent into the shape of a helix (or spiral) so that it has the proportions of a very long, narrow cork screw. When bent into such a shape, the rod may aptly be described as a coiled member. A preferred material for such a rod is about ⅛ to 3/16 inch steel that has been cadmium-plated or the like, to render it rust-proof. A suitable diameter for such a helical rod is about 2 inches, and it has a pitch of about 3 to 4 inches. A small pitch will likely be more suitable for light garments (like rayon), and a large pitch will more likely be suitable for heavy garments (like denim). In another embodiment, the structural frame constitutes a solid, straight rod of a rigid material (e.g., wood, plastic or the like), said rod having a diameter of about 2 inches. protruding outwardly from the straight rod are a plurality of generally L-shaped hook-like protrusions that are arranged in a helical pattern that extends from near the top of the rod to near the bottom thereof. As with the first embodiment, the helical pattern of hook-like protrusions preferably has a pitch of about 3 to 4 inches; that is, any two adjacent and vertically aligned protrusions have differences in elevation of about 3 to 4 inches. In still another embodiment, the straight, central solid rod is replaced with a thin-walled hollow tube having a diameter of about 2 inches. A plurality of venting holes are distributed throughout the tube's wall, such that the tube may be aptly described as foraminous; in this embodiment air may circulate through the plurality of holes to foster drying of a garment from the inside as well as the outside. Drying of a wet garment may be speeded up by mounting a conventional electric hair drier so it discharges warm air directly into the core of a tubular frame.

Another optional feature of the combination is a means for holding the structural frame in a generally vertical manner during use. One embodiment of this fourth feature is a large hook that is provided at the top of the structural frame, said hook being adapted to be placed over a clothes-hanging hook or a closet rod, etc. To accommodate the upper part of a dress (i.e., that part of a dress above the waist that does not have pleats), the supporting hook may be placed above a member that is shaped like a conventional clothes hanger. Alternatively, a relatively small, narrow hook may be provided at the top of the structural frame, so that the small hook may be readily placed over the horizontal part of a conventional clothes hanger. In this embodiment, the structural frame can be made to hang vertically from near the central part of a conventional clothes hanger. In still another embodiment, a means for holding the structural frame in a generally vertical manner comprises a generally horizontal stand or base that is rigidly attached to the bottom of the structural frame. In such an embodiment, the generally horizontal stand will have a size and shape that may remind a person of the base of a floor lamp or the like.

In use, it will be assumed that a garment has been washed and it is still wet or at least very damp. The top of the garment is folded upon itself, to the extent necessary, and then secured to the top of the structural frame—with a clamp or a strap or the like. With the top of the garment being anchored at the top of the frame, the body of the garment is then brought together and progressively wrapped (like a large rope) in a spiral manner around the frame—until essentially all of the garment is intimately engaged with the frame. The length of the structural frame must, of course, be great enough to extend for at least the full length of a twisted garment; and, to provide what may be called an insurance factor, the frame is advantageously made longer than that of the longest garment that is to be handled. In the first embodiment of the apparatus (i.e., the one with a spiral-shaped steel rod), the garment is progressively wrapped between adjacent turns of the rod, with the result that the garment is automatically "gripped" and held in a twisted manner—without the need to place any kind of a shroud around it. With a bulbous garment, sections of the rod serve to gently squeeze adjacent portions of the garment inwardly, while those portions of the garment that are between adjacent rod sections are allowed to "blossom" or bulge outwardly. Incremental sections of the rod in a given vertical plane will be at fixed and uniform distances apart, with the result that the garment will be held at evenly spaced and controlled positions from the top of the garment to the bottom thereof. In an embodiment with a central core and a plurality of cantilevered hooks, a garment is secured at the top of the core—and then is progressively wrapped around the core, with sequential segments of the garment being squeezed into the peripheral spaces between the core and the upwardly pointing portions of the various hooks. To absolutely ensure that the garment will not have any tendency to "unwind" as it dries, a strap or rubber band or the like may be used to wrap around the bottom of the garment—to hold it securely to the structural core.

DETAILED DESCRIPTION OF A FIRST EMBODIMENT OF THE INVENTION

Referring initially to FIG. 1, a "broomstick" skirt 10 is shown in a drying position—wrapped like a rope around the elongated handle or "stick" 12 of an exemplary broom of the prior art. The skirt 10 is often tied in several places from the top of the stick 12 to its bottom, using strings 14 that are tied in a conventional manner, using a simple and releasable knot similar to the kind of knot that people commonly use to tie their shoe laces. Alternatively, a twisted skirt may be held in a twisted state around a prior art stick 12 by pulling one leg of a pair of pantyhose over the twisted skirt. In both situations, it is advantageous to have two people working on the task of mounting a skirt for drying, because—as a practical matter—at least three hands are needed to handle the job in a convenient manner. After the skirt has dried, whatever knots are present are untied so that the strings will fall away from the stick 12. The skirt 10 is then grabbed at its top and given a few shakes that may vary from gentle to vigorous, so that the pleats will assume a desired shape.

Figure 2:
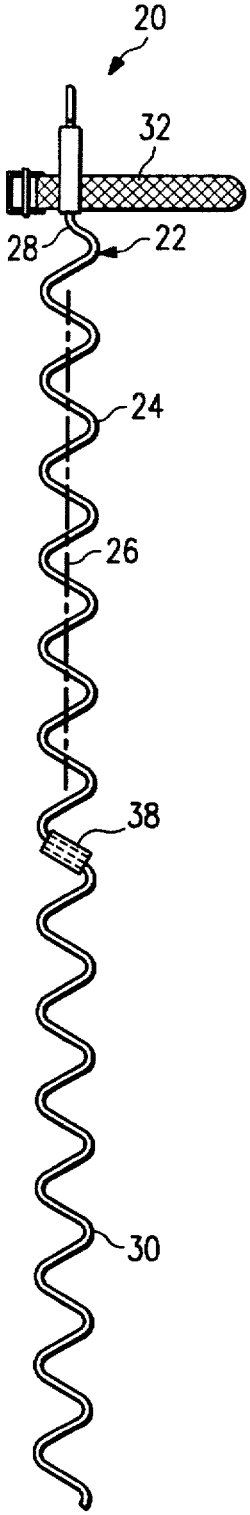
FIG. 2 is a front elevational view of one embodiment of an apparatus in accordance with the invention, said embodiment being in the form of a rigid member (like a rod) that has been bent into the shape of a helix (or spiral)

Turning next to FIG. 2, a first embodiment of the invention 20 constitutes a structural frame 22 that has a narrow, cylindrical rod 24 that has been bent in a helical (spiral) manner to provide a structural support for a woman's garment (e.g., a skirt). A preferred material for the rod 24 is mild steel having a diameter of about 3/16 inch; it is bent into a helix whose internal diameter is about 1.5 to 2 inches, and whose pitch is about 3 to 4 inches. The structural frame has a central axis 26 with a top 28 and a bottom 30. To render the rod 24 rust proof, it is preferably cadmium-plated or powder coated. Alternatively, it may be dipped into a tank of epoxy paint of a desired color. In any event, the rod 24 should have a surface that will render it immune to any kind of moisture for a very long time, so that the apparatus 20 might be used for years in drying wet garments, etc., without leaving any stains or otherwise doing any cosmetic damage to the garments. At the top of the rod 24 is a transversely oriented strap 32 that can be readily wrapped around the top of a skirt. Once the top of a skirt has been secured to the rod with a buckle or other fastener, it is easy to simply impart a slight twist to the skirt and squeeze it into the space between vertically aligned segments of the rod 24. Only two hands need be used in this task, so a helper is not required for most people.

Figure 3:
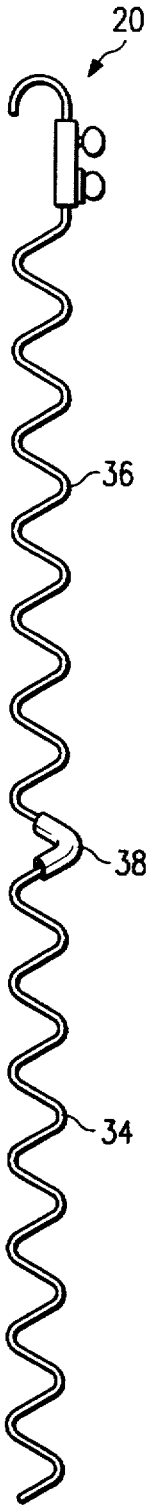
FIG. 3 is a side elevational view of the apparatus shown in FIG. 2.

FIG. 3 shows how the rod may be assembled by connecting together, end to end, two sections of coiled rod; a lower section 34 and an upper section 36 are shown held together by a tubular member 38. The opportunity to separate a rod 24 into two aligned sections 34, 36 makes it easier to package, ship and/or store the rod. Too, allowing a customer to assemble two or more sections can provide for an advantageous adjustment in the length of the structural frame 22. For example, a user can put together three longitudinally aligned sections and use them to hold a long skirt; or, a user can simultaneously use three individual sections for three pairs of golf shorts, etc.

Figure 4:
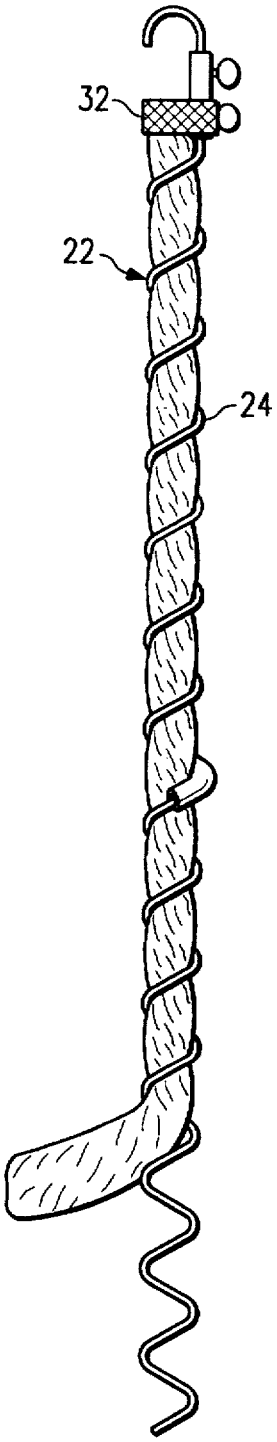
FIG. 4 is a front elevational view of the apparatus shown in FIG. 2, with a woman's skirt being shown installed in the apparatus.

FIG. 4 shows the manner of inserting a skirt into a structural frame 22. Assuming that the skirt is initially wet or at least damp, it is left in this captured state until it is dry. Once dry, the skirt may be removed from the frame 22, or it may simply be left in the frame for as long as seems to be desirable—in what may be called a storage mode. A dry skirt may also be installed in a frame 22 at any time, including a skirt that has already been worn once but is still capable of being worn again—because it does not absolutely require cleaning.

Depending on the bulk of the garment that is to be suspended on a structural frame 22, it may be advantageous to secure the bottom of the garment of the frame—to prevent the garment from becoming prematurely unwound. This can be done with a strap that is similar to the strap 32 shown at the top of the frame 22. But many garments will remain in a desired position within a helical rod 24 without having any propensity to unwind, especially if the garment is relatively bulky or stiff (like denim). That is, the helical rod 24 serves as an elongated restraint against unwinding of a garment, as well as providing equally spaced "griping" places that are distributed along the length of the garment.

FIGS. 5 and 6 are enlarged views of the top of a structural frame 22. A cylindrical connecting device 40 has upper and lower thumb screws 42, 44 that, when tightened against adjacent sections of rod, securely connect the helical section to a supporting hook 46. The strap 32 is provided with an aperture and is permanently affixed to the top of the rod 24 by passing the threaded shank of the lower thumbscrew 44 through the aperture.

FIGS. 7 and 8 are enlarged views of an advantageous manner of connecting helical rod sections 34, 36 so that the sections will be longitudinally aligned. A connector 38 may be readily used to connect the two helical sections without the requirement for any tools, by pushing the respective ends of the rod sections 34, 36 into opposite ends of the connector. There are not any great loads on the connector 38, so it does not need to be made of a high-strength material such as steel. But if the connector is made of steel or some other metal than can be deformed or shaped, then crimping it after the ends of the rod sections have been inserted will render the connection essentially fixed. On the other hand, a connector that is made of a resilient material can be disconnected at will, so that upper and lower rod sections may be joined for use and then disconnected for compact storage.

Figure 9:
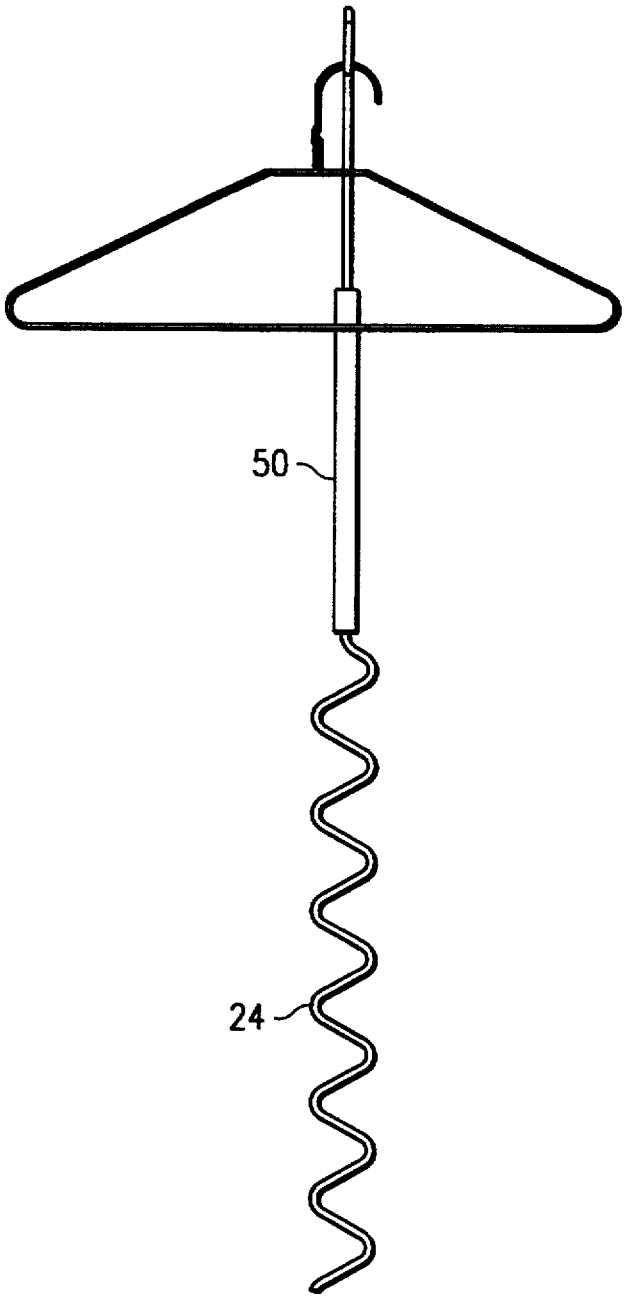
FIG. 9 is an elevational view of an embodiment in which a helical member is suspended below a hanger that will support the upper part of a dress.
Figure 10:
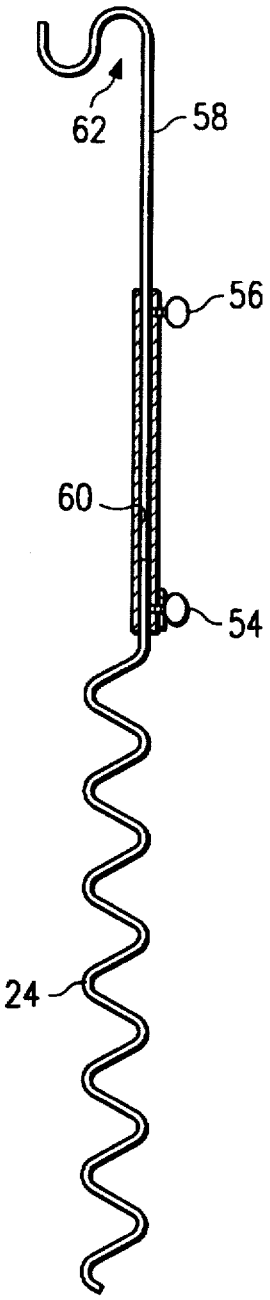
FIG. 10 is an elevational view of the embodiment shown in FIG. 9, taken from a direction that is perpendicular to the view of FIG. 9.

FIGS. 9 and 10 show an embodiment of the invention that is particularly suitable for hanging dresses that have pleats below the waist and relatively flat material above the waist. Above the helical section of the rod 24 is a linear extension 50 that may be connected to the helical section with a thumbscrew 54. An upper thumbscrew 56 is used to secure an elongated hook 58 to the extension 50 and hence to the helical section 24. The hook 58 is shown in its lowest relative position with respect to the helical piece 24; the hook's bottom 60 is shown abutting the topmost part of the helical section. If the length of the dress should dictate, the hook 58 may be raised a few inches, so that the non-pleated part of the dress will be adequately above the coiled section of the frame 22. Of course, the length of extension 50 is greater than that of cylinder connector 40, so that the hook 58 might be adjusted a significant amount with respect to the helical frame.

The top of hook 58 has an "S" configuration that is oriented horizontally instead of vertically. The inner portion 62 of the hook 58 opens downwardly, so that it might might be suspended from a fixed clothes hook or the like. The outer portion 64 of the hook 58 opens upwardly, so that it might receive and support the hook of a conventional clothes hanger. Hence, a conventional clothes hanger may be manually placed inside a dress and adjusted so that the dress is centered on the hanger in a traditional manner. The clothes hanger is then hung on the outer portion 64 of the hook. Depending on the height relationship of the hook 58 and the lower part of the dress (where the pleats are), the upper thumbscrew 56 may be loosened; the hook may then be raised or lowered as appropriate, and the thumbscrew tightened again. Turning attention to that part of the dress with pleats, the highest portion is then manually gathered, twisted gently into a rope-like quantity of cloth, and wedged into the top of the helical frame 22. Of course, the upper (non-pleated) part of the dress is adequately supported by the coat hanger, so there is no risk that the pleated part of the dress will fall downwardly off the apparatus 20. But the strap 32 may optionally be wrapped around the top of the pleated part of the dress and secured with a buckle, to ensure that there will be no strain on the upper part of the dress as it is manipulated at its lower part. Successively lower portions of the pleated part of the dress are then progressively forced transversely into the open portions of the coiled frame 22—until the entire dress has been mounted on the apparatus.

Another embodiment, which is presently considered to be the preferred embodiment, is shown in FIGS. 11, 11A and 12. This embodiment of a clothing hanger/holder 20A is made of a piece of hard-drawn, spring-steel wire that is about ⅛ inch in diameter; it has been bent into a helical shape with a diameter of about 1.75 inches and a pitch of about 3.25 inches. The preferred length of this one-piece steel wire embodiment 20A is about 38 inches, including a coiled length of about 30 inches (including nine coils), and having a straight (or upper) section that is about eight inches long. The upper section is terminated with a down-wardly opening hook 66 that is large enough to readily go over the horizontal part of a regular coat hanger. For such an embodiment, the length of a piece of wire before it is shaped is about 73 inches, and its weight is about four ounces. While the structural holder is expected to be suspended in a generally vertical manner during use, it is sufficiently rigid as to hold its shape when it is held horizontally at a single support point (without the weight of a garment). Expressed in other words, the structural member has enough rigidity to resist permanent deformation and maintain its formed shape in most situations. However, like the handle of a conventional flyswatter, it can be temporarily deflected without suffering any adverse effects. Hence, if it should be dropped on the floor and thereby subjected to an unusual transverse load, it may temporarily flex or bend but it will suffer no permanent damage.

Turning next to FIGS. 13 and 14, an embodiment of the invention with a solid central core 68 is shown, with a plurality of cantilevered arms 70 that are permanently affixed to and extend radially outward from the core. The series of points where the several arms intersect the exterior surface of the core are arranged in a regular, helical pattern that extends downwardly around the core 68. Each arm 70 extends outwardly from the core for a distance of about two to three inches; at the distal end of each arm there is optionally provided an upwardly extending element 72 having a length of about ½ inch. The combination of an horizontal arm 70 and an upwardly extending element 72 creates a general "L" shape when viewed from the side; and a plurality of such combinations form a predictable and regulated support for a garment that is to be suspended about the holder. This full-length support along the central core 68 prevents a garment from slumping along its length, plus it is firmly held at its top. The vertical spacing between a given "set" of any two aligned arms is preferably about three inches. Of course, this vertical spacing (between aligned arms) corresponds to the aforementioned pitch of the coils of the helical structural member.

In use of the embodiment 20B of FIG. 13, a skirt or equivalent garment is mounted in essentially the same manner as the coiled wire embodiment, starting with the step of fixing the top of a garment to the top of the structural frame. A short wire arm with a clothespin-style clamp 74 is optionally provided for this purpose. The garment is then progressively twisted and wrapped around the central core 68 until the bottom of the garment is reached. A modest amount of tension in the garment as it is wrapped around the core will normally preclude it from falling away from the core; however, if the user should happen to accidentally lose his or her grip on the garment, the upwardly extending elements 72 will help ensure that the garment will not slump or fall off the holder. So the elements 72 have the potential to do some good; but it should also be appreciated that if the elements are too tall, they will close off too much of the "throat" through which a garment is passed as it is manually wrapped around the central core 68. When the bottom of the garment has been reached, a judgment may be exercised by the user, depending upon the nature of the garment's material. If the garment seems to be stable and shows no tendency to unwind, it may simply be left alone. This will be the case in most, if not all, instances—especially if the garment is wet or at least very damp. But if the garment shows any tendency to unwind when it is manually released, a strap may be wrapped around the bottom of the garment (and the central core) to hold the garment securely in place. A sturdy rubber band may also be used for this purpose.

Turning next to FIGS. 15 and 16, a structural frame in the form of a hollow tube is shown before a garment is wrapped around it. In its general shape, it resembles the solid-core embodiment of FIG. 13, but it is clearly distinguishable by the plurality of holes 80 that are distributed along its length. These holes 80 permit warm air to pass from the interior of the hollow core to a garment that is wrapped around the core. An exemplary electric hair dryer 82 is shown in a working position on top of the tube 78, where it can expel warm air into the tube to foster drying. Naturally, the nozzle of the hair dryer is deliberately selected so that it will fit into the top of the hollow tube 78; with such an arrangement, the dryer may be properly positioned, turned on and then left alone for a few minutes while the garment is dried. The judicious combination of tube diameter and dryer nozzle may be though of as a means for holding a hair dryer with an orientation that will permit the dryer 82 to foster the drying of damp garments that are wrapped around the tube.

Each of the several embodiments of the invention may also be used to store dry garments that are not expected to be worn for several hours—or even days. Later, after removing a garment from one of the holders that has supported it for some time, the garment can simply be given a gentle shake and it will be ready to wear.

While there have been disclosed herein several embodiments of the invention, those skilled in the art will no doubt appreciate that still other variations of the basic concept could be made—without departing from the general theory of the invention. Thus, it is conceivable that variations in materials, sizes and shapes could be made in the embodiments that have been illustrated herein—while still preserving the principles that have been disclosed. Therefore, it should be understood that the invention should be measured only by the scope of the appended claims.

What is claimed is:

1. An apparatus for storing a garment in a twisted manner when it is not being worn, so that it will have a desired appearance when the time is appropriate for wearing the garment, comprising:

a) a structural frame having a top and a bottom and a generally longitudinal axis tending therebetween, and the structural frame having a length that exceeds the full length of a garment when said garment has been twisted about an axis that is coaxial with the longitudinal axis of the structural frame;

b) first means for securing the top of the garment to the top of the structural frame, the first means comprising a flexible strap that is manually wrapped around the top of the garment and the top of the structural frame, and further including a buckle placed so as to hold the flexible strap in a closed loop around the top of the garment with a force that is adequate to hold the garment in a supported position while it is being wrapped around the structural frame;

c) second means for securing the bottom of the garment to the bottom of the structural frame, and the first and second means being held against relative movement to any torque that is applied to the first and second means as a result of the step of securing the top of the garment to the top of the structural frame and wrapping the garment around the structural frame; and d) third means for holding the garment at a plurality of fixed and substantially equally spaced locations between the top and the bottom of the structural frame.

2. A combination including an apparatus for holding the bulk of the material in a garment while the garment is drying after it has been washed, comprising:

a) a garment having a top and a bottom and a large body of washable material that extends between the garment's top and its bottom, and the garment being adapted to be twisted in the manner of a rope about a generally longitudinal axis that extends from the garment's top to its bottom;

b) a structural frame having a top and a bottom and a generally longitudinal axis extending therebetween, the structural frame comprising a helical-shaped member;

c) first means for securing the top of the garment to the top of the structural frame; and d) second means for securing the bottom of the garment to the bottom of the structural frame, and the first and second means being held against relative movement in response to any torque that is applied to the first and second means as a result of the step of wrapping the garment's body in a twisting manner around the structural frame, whereby a wet garment may be allowed to dry in a controlled position while it remains twisted around the structural frame.

3. The combination as claimed in claim 2 and further including a hook-shaped member that is located at the top of the structural frame, whereby the structural frame may be suspended in a vertical manner from a fixed support.

4. The combination as claimed in claim 3 wherein the hook-shaped member is selectively attachable to the top of the structural frame, and the size of the hook-shaped member being large enough so that the hook-shaped member and the structural frame can be suspended from a closet rod having a nominal diameter of about 1.75 inches, whereby a garment that is mounted on the structural frame may be vertically suspended from a closet rod while the garment is drying.

5. The combination as claimed in claim 2 and further including a base that is selectively attachable to the bottom of the structural frame for supporting the structural frame in a generally vertical orientation, and the base having a size that is adequate to provide stability for the structural frame both when it is empty and when a garment has been mounted thereon.

6. The combination as claimed in claim 2 wherein the structural frame constitutes a generally solid rod having a diameter of about 2 inches and a length of at least 2 feet.

7. The combination as claimed in claim 2 wherein the structural frame comprises an elongated core having a plurality of arms that protrude radially outward from the core at spaced locations that extend along substantially the full length of the elongated core.

8. The combination as claimed in claim 2 wherein the elongated core is hollow and has a plurality of apertures extending from the core's interior to its exterior, whereby air may circulate inside the elongated core and come into contact with parts of a garment that has been wrapped around the elongated core, whereby internally circulating air can foster the process of drying a garment that has been wrapped around the elongated core.

9. The combination as claimed in claim 8 and further including means for holding an electrically powered hair dryer with an orientation such that warm air generated by the hair dryer can be propelled in a downward direction into the hollow core, whereby the rapid drying of a garment may be fostered after a wet garment has been wrapped around the hollow core.

10. The combination as claimed in claim 2 and further including means for holding in an untwisted manner a non-pleated portion of a garment above a lower portion of the garment that is to be twisted around the structural frame.

11. The apparatus as claimed in claim 1 wherein the structural frame comprises a helical-shaped member having a pitch that is sufficiently large as to permit portions of a garment to be manually forced between longitudinally aligned and spaced-apart segments of the helical-shaped member.

12. The apparatus as claimed in claim 11 wherein the helical-shaped member is formed of wire having the physical properties of spring steel and having a diameter within the range of about ⅛ inch to ¼ inch.

13. The apparatus as claimed in claim 11 wherein the helical-shaped member has a diameter of about two inches, a length of at least 24 inches, and there is a distance between longitudinally aligned and spaced-apart segments on the order of 4 inches.

14. The combination as claimed in claim 2 wherein the helical-shaped member has a diameter within the range of about 1.75 to 4 inches and a length of at least 24 inches.

15. The combination as claimed in claim 2 wherein the helical-shaped member has a serial array of coils and a pitch that is measured as the distance between two similarly positioned segments that are vertically located with respect to one another in two adjacent coils, and the pitch of the helical-shaped member is within the range of about 3 to 4 inches.

16. The combination as claimed in claim 2 wherein the helical-shaped member comprises a plurality of similarly shaped members that are connected together in an end-to-end fashion, such that the total length of the helical-shaped member is at least twice as great as the length of a single shaped member.

* * * * *